US006939164B2

(12) United States Patent
Noro

(10) Patent No.: US 6,939,164 B2
(45) Date of Patent: Sep. 6, 2005

(54) CONNECTOR AND CONNECTOR ASSEMBLY

(75) Inventor: Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/844,762

(22) Filed: May 13, 2004

(65) Prior Publication Data

US 2004/0235340 A1 Nov. 25, 2004

(30) Foreign Application Priority Data

May 14, 2003 (JP) ..... 2003-136200

(51) Int. Cl.[7] ..... H01R 9/05
(52) U.S. Cl. ..... 439/492; 439/499; 439/686
(58) Field of Search ..... 439/579, 578, 439/492, 493–499, 686

(56) References Cited

U.S. PATENT DOCUMENTS 4,767,357 A * 8/1988 Hasircoglu ..... 439/499
4,993,969 A * 2/1991 Cabourne ..... 439/499
5,358,424 A * 10/1994 Bowen et al. ..... 439/405
6,152,781 A * 11/2000 Huang ..... 439/686
6,383,033 B1 * 5/2002 Politsky et al. ..... 439/686
6,491,536 B1 * 12/2002 Torii ..... 439/246
6,527,595 B1 3/2003 Watanabe ..... 439/682

FOREIGN PATENT DOCUMENTS

JP 3-266384 of 1991

* cited by examiner

*Primary Examiner*—Michael C. Zarroli
(74) *Attorney, Agent, or Firm*—Gerald E. Hespos; Anthony J. Casella

(57) ABSTRACT

A connector has wire-side terminal fittings (30) with wire connecting portions (31) and wire-side contact pieces (35). The wire-side terminal fittings (30) are divided into upper and lower stages with their wire connecting portions (31) disposed one over the other to narrow the width of a connector. The wire-side contact pieces (35) are narrower than the wire connecting portions (31). Thus, two wire-side contact pieces (35) at the upper and lower stages can be arranged side by side at substantially the same height in a width area taken up by one wire connecting portion (31). Accordingly, the connector can have a short height.

17 Claims, 9 Drawing Sheets

CONNECTOR AND CONNECTOR ASSEMBLY

BACKGROUND OF THE INVENTION

1. Field of the Invention

The invention relates to a connector for connecting a flat cable with an electric or electronic circuit or device, such as a circuit board.

2. Description of the Related Art

U.S. Pat. No. 6,527,595 discloses a connector for connecting wires of a flat cable to a circuit board. The connector has a wire-side connector and a board-side connector. Wire-side terminal fittings are disposed side-by-side in the wire-side connector for connection with the wires of the flat cable and board-side terminal fittings are disposed side-by-side in the board-side terminal for connection with the circuit board.

Long narrow contact pieces are formed at the leading ends of the wire-side terminal fittings and the board-side terminal fittings and project substantially parallel to a connecting direction of the connectors. The contact pieces are connected electrically with each other from above and below by connecting the wire-side terminal fittings and the board-side terminal fittings.

Consideration has been given to dividing the wire-side terminal fittings into upper and lower stages to achieve a narrower connector. However, the contact pieces at the upper stage are over the contact pieces at the lower stage, and as a result, the connector is taller. More particularly, the contact pieces at one side may be forked and those at the other side may be pressed into the forked contact pieces to ensure contact stability, as shown in Japanese Unexamined Patent Publication No. H03-266384. Thus, six contact pieces are located one over another in the two-stage connector, and the height of the connector is considerably larger.

The present invention was developed in view of the above problems and an object thereof is to maximally suppress the height of a connector that has wire-side terminal fittings at upper and lower stages.

SUMMARY OF THE INVENTION

The invention relates to a connector assembly for connecting a substantially flat cable with an electric or electronic circuit or device, such as a circuit board. The connector assembly comprises a wire-side connector and a board-side connector. The wire-side connector accommodates wire-side terminal fittings for connection with wires of the flat cable, and the board-side connector accommodates board-side terminal fittings for connection with the electric or electronic device. The wire-side terminal fittings are divided into two stages, and are arranged substantially side by side at each stage. The wire-side terminal fittings and the board-side terminal fittings are electrically connectable by bringing wire-side contact pieces of the wire-side terminal fittings into contact with board-side contact pieces of the board-side terminal fittings from substantially opposite directions. The wire-side contact pieces and the board-side contact pieces are narrower than wire connecting portions of the wire-side terminal fittings. Additionally, each pair of corresponding wire-side terminal fittings are arranged so that the wire connecting portions at least partly overlap in a transverse direction substantially normal to the connecting direction and so that the wire-side contact pieces thereof are arranged substantially side by side at the same height in a width area taken up by one wire connecting portion. Thus, the height of the connector is shorter than connectors that have the contact pieces at the first and second stages located one over the other.

Either the wire-side contact pieces or the board-side contact pieces preferably are forked and squeeze the other contact pieces from opposite sides to connect the wire-side terminal fittings and the board-side terminal fittings electrically. A high contact pressure is ensured by the resilient force of the forked contact piece. Accordingly, no load for ensuring a contact pressure acts on the housings that accommodate the terminal fittings.

The forked contact piece preferably includes first and second squeezing pieces having different projecting lengths along a connecting direction of the two connectors.

The wire-side terminal fittings at the first stage and second stages preferably are substantially the same in structure, but are arranged in a vertically inverted relationship at the respective first and second stages.

A holding means preferably is provided in the wire-side connector and/or the wire-side contact piece for holding the wire-side contact piece with respect to the wire-side connector.

The wire-side connector preferably comprises terminal accommodating portions for receiving the wire-side terminal fittings. Adjacent terminal accommodating portions may be partitioned by partitioning walls.

Each terminal accommodating portion preferably comprises a wider accommodating portion for accommodating the wire connecting portion and a narrower accommodating portion for accommodating the wire-side contact piece. The narrower accommodating portion preferably has a width which is less than about half of the width of the wider accommodating portion.

Shielding shells preferably are provided for substantially shielding the connectors to be used for shielded wires.

These and other features of the invention will become more apparent upon reading the following description of preferred embodiments and the drawings. Even though embodiments are described separately, single features may be combined to additional embodiments.

DETAILED DESCRIPTION OF THE PREFERRED EMBODIMENTS

Figure 1:
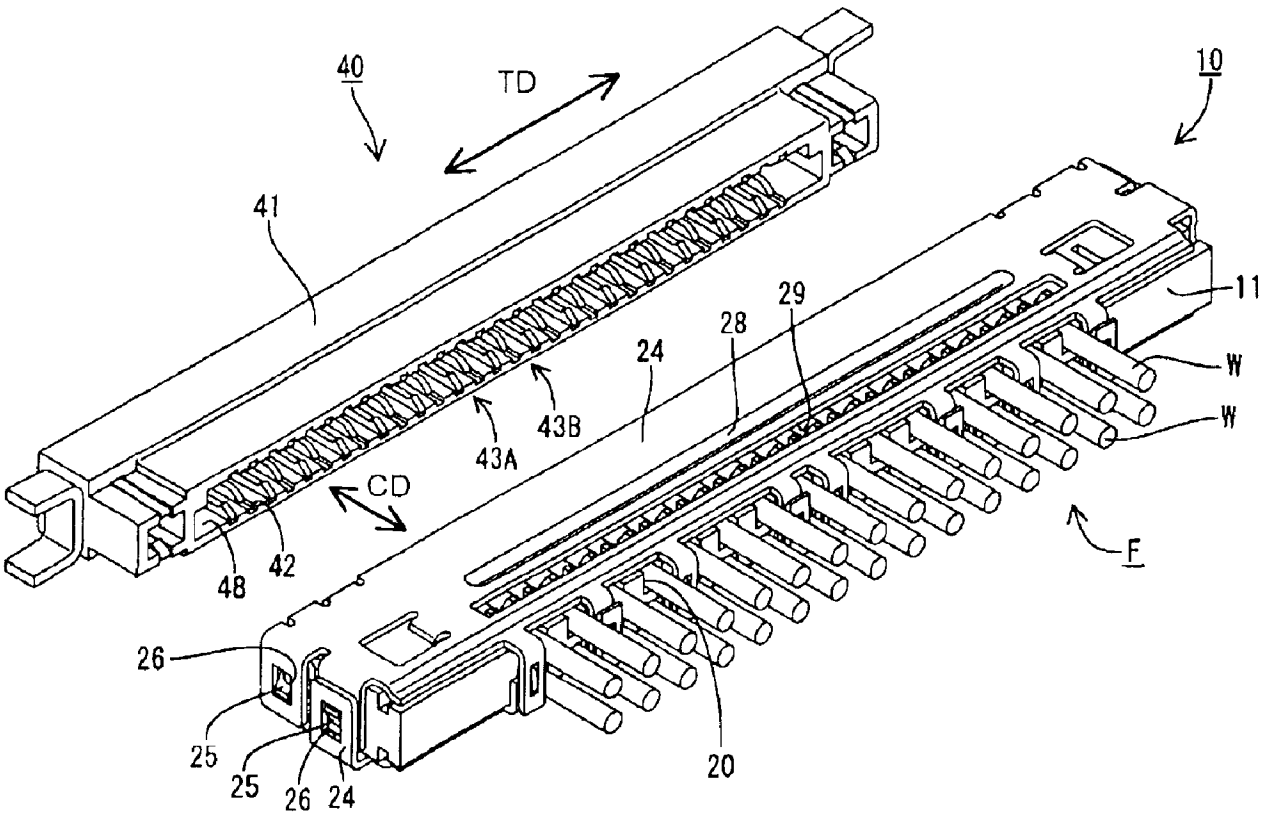
FIG. 1 is a perspective view showing a separated state of a wire-side connector and a board-side connector according to the invention.
Figure 2:
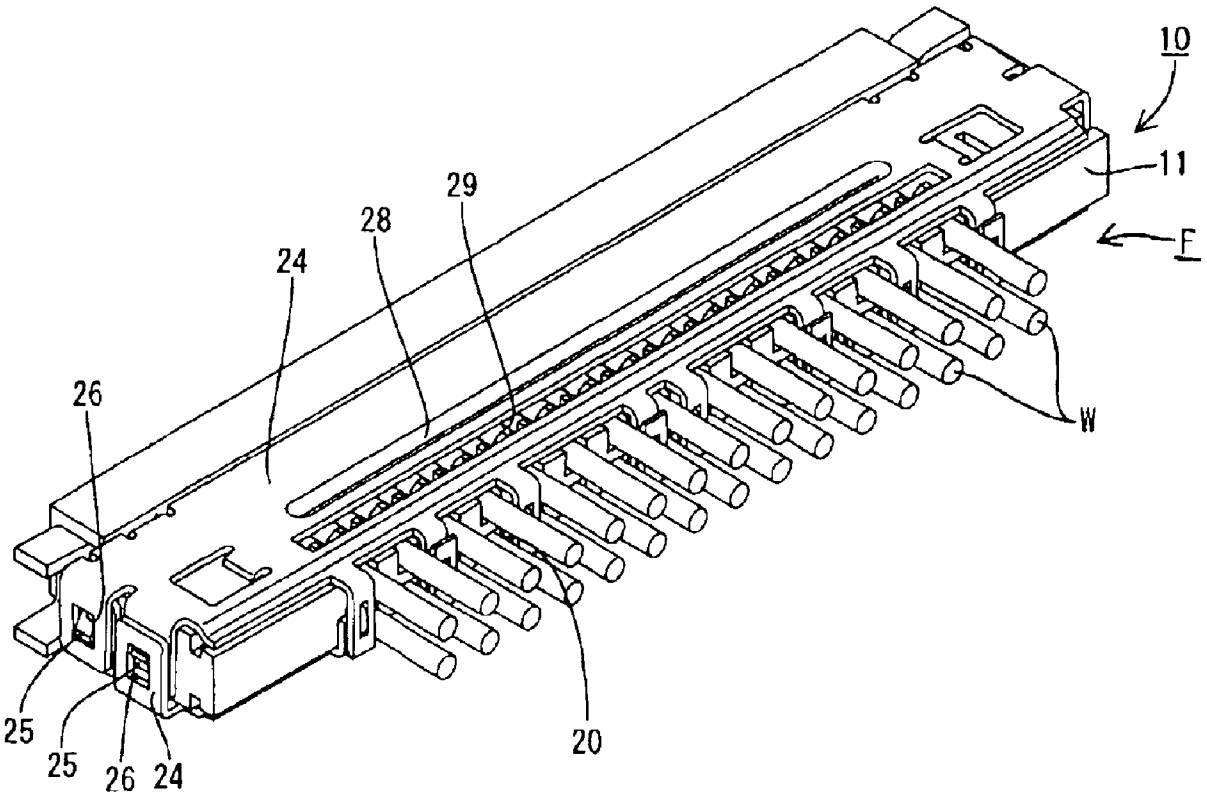
FIG. 2 is a perspective view showing a connected state of the wire-side connector and the board-side connector.
Figure 3:
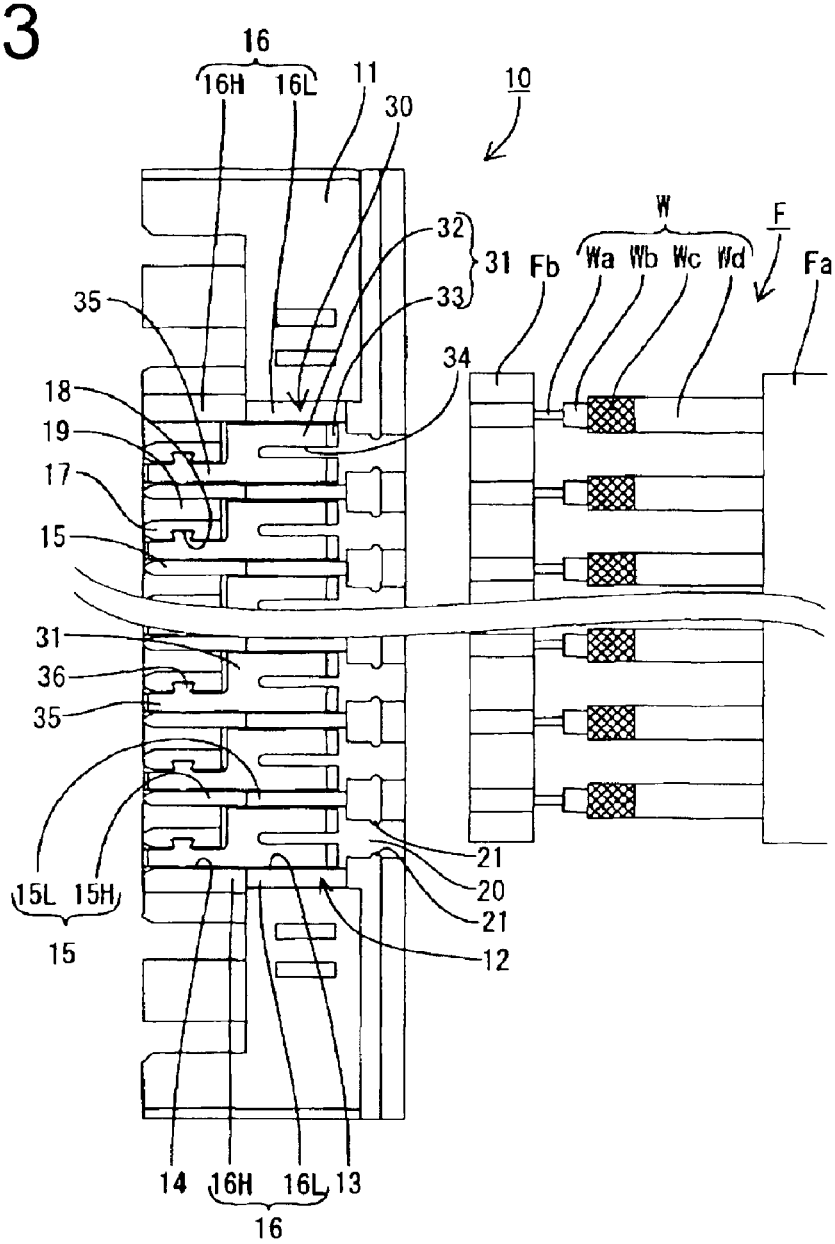
FIG. 3 is a plan view of the wire-side connector and a flat cable.

A connector according to the invention is illustrated in FIGS. 1 to 9 and connects flat cables F to a printed circuit board P. The connector includes a wire-side connector 10 that accommodates wire-side terminal fittings 30 to be connected along a connecting direction CD with wires W of the flat cables F. The connector also includes a board-side connector 40 that accommodates board-side terminal fittings 43A, 43B to be connected with the circuit board P.

Each flat cable F has parallel wires W arranged at specified intervals and secured to a flexible sheet Fa. Each wire W is shielded and has an inner conductor Wa covered by a core Wb made of an insulating resin. A tubular shielding layer Wc made of a braided wire or other conductive material is mounted on the outer surface of the core Wb, and a sheath Wd made of an insulating resin covers the shielding layer Wc. The sheath Wd is stripped at an end of each wire projecting from the sheet Fa to expose the shielding layer Wc. The core Wb is exposed slightly from the leading end of the shielding layer Wc, and the inner conductor Wa is exposed and projects from the leading end of the core Wb. The leading ends of the exposed inner conductors Wa of the respective wires W are coupled by an insulating resin coupling Fb that is narrow and wide in the transverse direction TD, and exposed portions of the inner conductors Wa are arranged at specified intervals by the coupling Fb.

The wire-side connector 10 includes an insulating resin housing 11 that is narrow and wide in the transverse direction TD. The wire-side terminal fittings 30 are assembled into the housing 11 and a shielding shell 24 substantially surrounds the housing 11. The face of the wire-side connector 10 that is to be connected with the board-side connector 40 is considered the front.

Terminal accommodating portions 12 are formed substantially side-by-side at substantially the same intervals as the wires W on the upper stage of the housing 11. The terminal accommodating portions 12 are recesses that open in the upper, front and rear surfaces of the housing 11. A wide accommodating portion 13 is formed at a rear of each terminal accommodating portion 12 and a narrow accommodating portion 14 is formed at a front thereof. The bottom surfaces of both accommodating portions 13, 14 are substantially flat, flush with and continuous with each other.

Partition walls 15 partition the adjacent wide accommodating portions 13. Each partition wall 15 has a high front section 15H and a low rear section 15L. Outer walls 16 are provided at the left and right sides of the wide accommodating portions 13. Each outer wall 16 has a high front section 16H and a low rear section 16L that have substantially the same heights as the high front sections 15H and the low rear sections of the partition walls 15.

Figure 4:
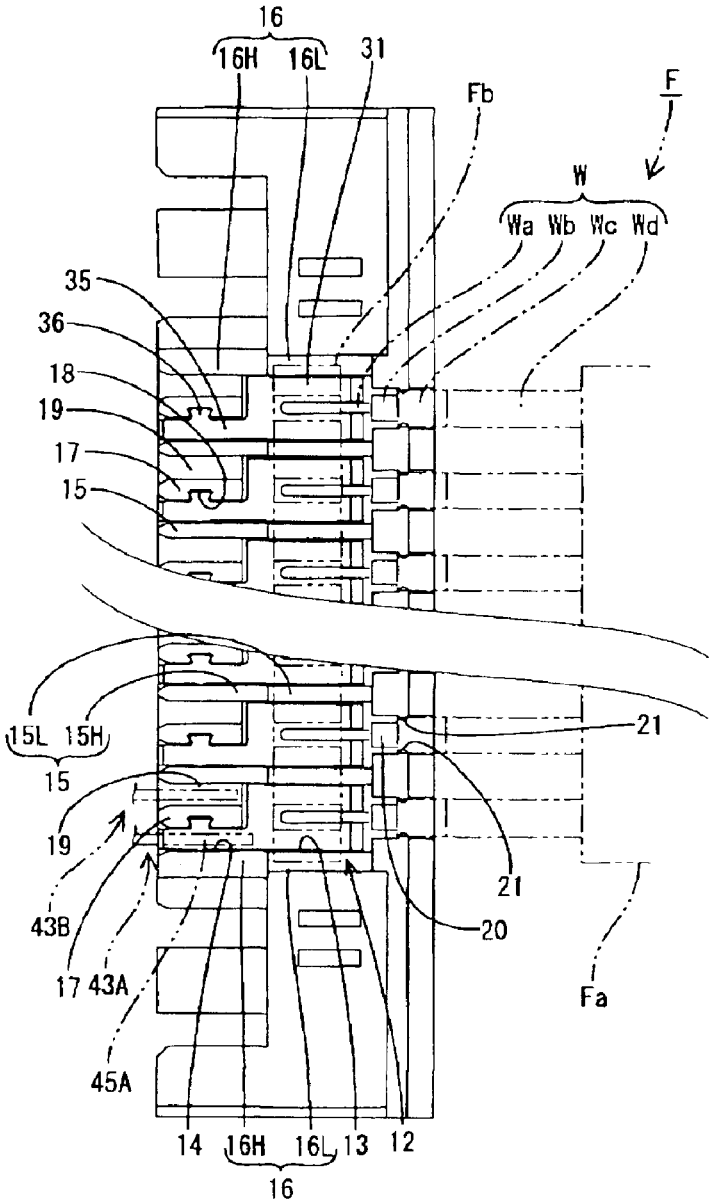
FIG. 4 is a plan view showing a state where the flat cable is connected with the wire-side connector.
Figure 5:
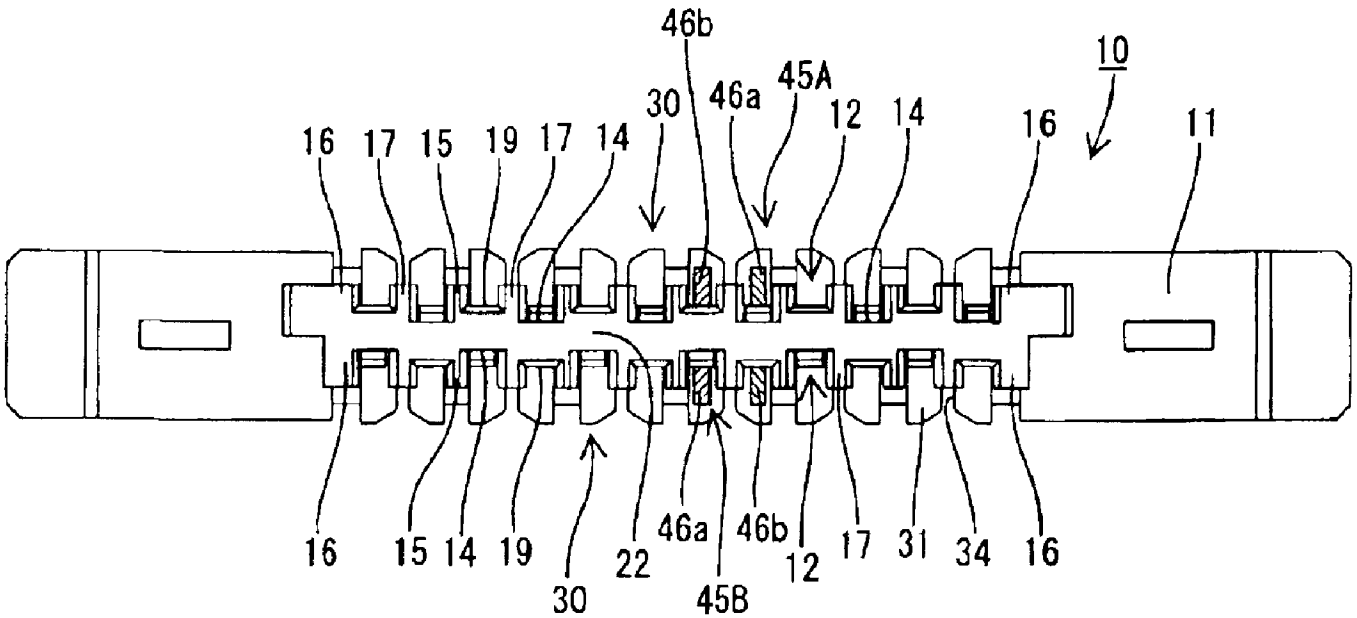
FIG. 5 is a front view of the wire-side connector.
Figure 6:
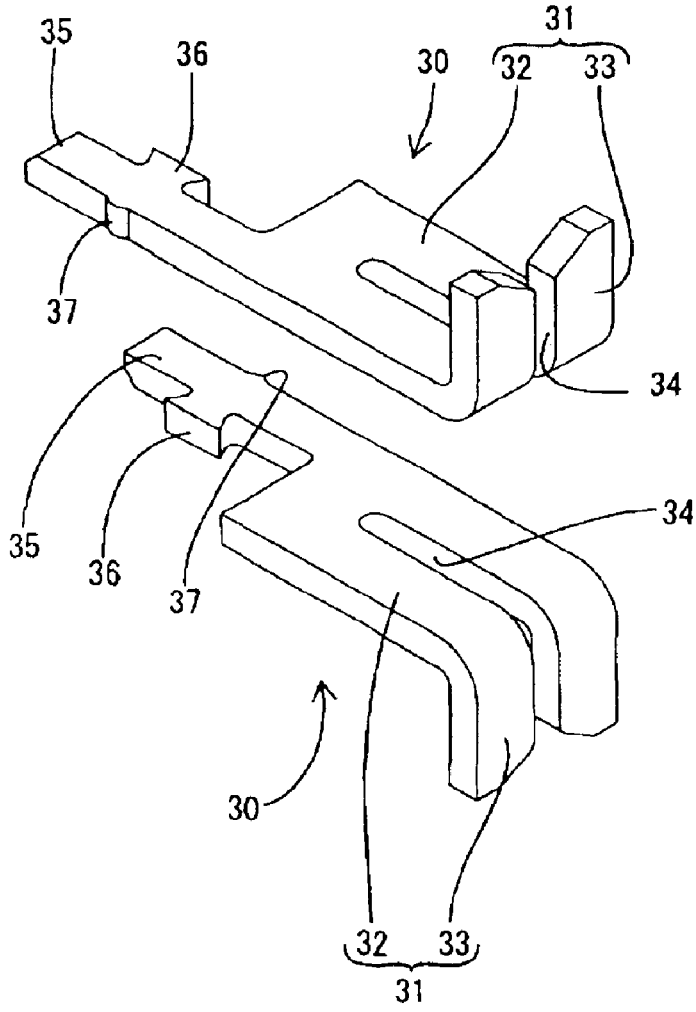
FIG. 6 is a perspective view showing the shape and the positional relationship of wire-side terminal fittings at upper and lower stages.
Figure 7:
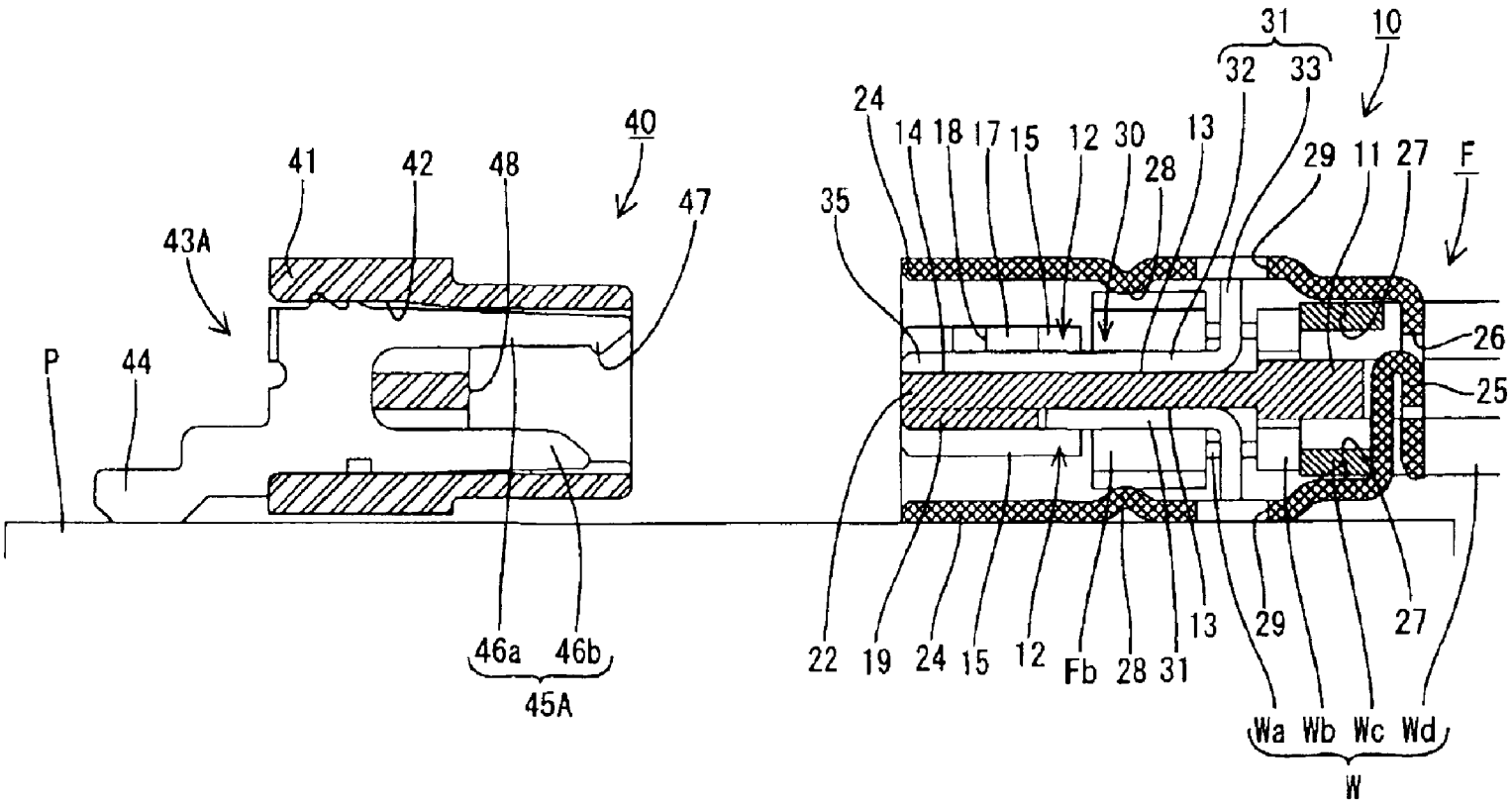
FIG. 7 is a section showing the separated state of the wire-side connector and the board-side connector.

The narrow accommodating portions 14 have a width less than about half, and preferably about ⅓ of the width of the wide accommodating portions 13 and communicate with the left front ends of the corresponding wide accommodating portions 13. Holding walls 17 are disposed before the wide accommodating portions 13 and align substantially with the widthwise middles of the wide accommodating portions 13. The holding walls 17 have substantially the same height as the high front sections 15H of the partition walls 15. The narrow accommodating portions 14 are between the holding walls 17 and the partition walls 15 and between the holding wall 17 and the outer wall 16 at the left end. A substantially vertical holding groove 18 is formed in the side surface of each holding wall 17 facing the narrow accommodating portion 14 and opens at the upper end of the holding wall 17. Each holding groove 18 is undercut to define a dovetail or trapezoidal cross section that is narrower towards the narrow accommodating portion 14 (FIG. 4). A receiving portion 19 is recessed at a side of each holding wall 17 substantially opposite the narrow accommodating portion 14 and has substantially the same height as the low rear sections 15L of the partition walls 15.

Wire-accommodating portions 20 are formed at the rear end of the housing 11 and communicate respectively with the rear ends of the wider accommodating portions 13. The wire-accommodating portions 20 are recesses that open in the upper and rear surfaces of the housing 11. Squeezing projections 21 are formed at opposite left and right sides of each wire-accommodating portion 20.

Terminal accommodating portions 12 and wire-accommodating portions 20 are arranged transversely in the lower surface of the housing 11 at substantially the same intervals as the wires W. The terminal accommodating portions 12 and the wire-accommodating portions 20 in the lower surface substantially vertically align with those in the upper surface and are separated by a substantially horizontal partition wall 22. Pairs of vertically corresponding terminal accommodating portions 12 and pairs of vertically corresponding wire accommodating portions 20 are symmetrical with respect to a forward and backward axis that is parallel with the connecting direction CD of the connectors 10, 40. However, the narrow accommodating portions 14 are at the left sides of the wide accommodating portions 13 in the upper surface, while the narrow accommodating portions 14 are at the opposite right sides of the corresponding wide accommodating portions 13 in the lower surface. Further, the receiving portions 19 in the upper surface vertically correspond to the narrow accommodating portions 14 in the lower surface, and the narrow accommodating portions 14 in the upper surface vertically correspond to the receiving portions 19 in the lower surface.

Each wire-side terminal fitting 30 to be mounted in the terminal accommodating portion 12 in the upper surface is formed by bending, folding and/or embossing a conductive metallic plate stamped or cut to have a specified shape. A wire-connecting portion 31 is formed at a rear of the wire-side terminal fitting 30 for connection with the wire W. The wire-connecting portion 31 is bent substantially normal to the connecting direction CD to define an L-shape when viewed sideways with horizontal and vertical legs 32 and 33. A slit 34 extends from a position slightly behind the front end of the horizontal leg 32 to the upper end of the vertical leg 33. The slit 34 is substantially in the widthwise center of the wire connecting portion 31.

A wire-side contact piece 35 cantilevers forward from the left front of the horizontal leg 32 of the wire-connecting portion 31. The wire-side contact piece 35 is a long narrow bar that is substantially flush with the horizontal leg 32. As shown in FIG. 4, a holding projection 36 projects from the right edge of the wire-side contact piece 35. The holding projection 36 has a trapezoidal cross section to be wider along a rightward projecting direction. An auxiliary projection 37 is formed at the left edge of the wire-side terminal fitting 30 at substantially the same position as the holding projection 36 with respect to the connecting direction CD.

The wire-side terminal fitting 30 is mounted in the terminal-accommodating portion 12 in the upper surface by aligning the holding projection 36 with the holding groove 18 and pushing the wire-side terminal fitting 30 down. The wire-connecting portion 31 then is accommodated in the wider accommodating portion 13 while the holding projection 36 is pressed into the holding groove 18, and the wire-side contact piece 35 is accommodated in the narrow accommodating portion 14. The lower surface of the wire-side contact piece 35 contacts the bottom surface of the terminal-accommodating portion 12 when the wire-side terminal fitting 30 is mounted properly. Additionally, the upper surface of the wire-connecting portion 31 is at substantially the same height as the upper surface of the low rear section 15L of the partition wall 15, the upper surface of the low rear section 16L of the outer wall 16 and the upper surface of the receiving portion 19. Further, the auxiliary projection 37 bites in the right surface of the partition wall 15 or the right surface of the outer wall 16. Engagement of the holding groove 18 and the holding projection 36 prevents the wire-side terminal fitting 30 from moving along the connecting direction CD and/or the transverse direction TD, and friction created by pressing the holding projection 36 into the holding groove 18 prevents the wire-side terminal fitting 30 from coming out upward.

The wire-side terminal fittings 30 mounted into the terminal accommodating portions 12 in the lower surface are substantially the same as the wire-side terminal fittings 30 arranged at the upper surface. However, the wire-side terminal fittings 30 mounted in the terminal accommodating portions 12 in the lower surface are inverted from the postures of the wire-side terminal fittings 30 at the upper stage. The wire-side terminal fittings 30 of the lower stage are mounted from below, substantially opposite from those at the upper stage and are substantially point-symmetrical with respect to an axis parallel with the connecting direction CD of the connectors 10, 40. Accordingly, the receiving portions 19 in the upper surface vertically correspond to the wire-side contact pieces 35 at the lower stage. Additionally, the wire-side contact pieces 35 at the upper stage vertically correspond to the receiving portions 19 in the lower surface. Further, pairs of the wire connecting portions 31 of the vertically corresponding wire-side terminal fittings 30 are at least partly one over the other, and each pair of the wire-side contact pieces 35 of the vertically corresponding wire-side terminal fittings 30 are arranged substantially side-by-side at heights that differ only by the thickness of the partition wall 22 in a width area taken up by one wire connecting portion 31. Thus, the wire-side contact pieces 35 at the upper stage and those at the lower stage are offset from each other along the transverse direction TD when viewed from the front.

The wire-side terminal fittings 30 are mounted in the housing 11 as described above. The flat cable F then is positioned above the housing 11 so that the end portions of the wires W align substantially with the corresponding wire-side terminal fittings 30. The flat cable F then is lowered to press the exposed inner conductors Wa of the respective wires W into the slits 34 from the upper edges of the vertical portions 33 of the wire-connecting portions 31. Thus, the exposed inner conductors Wa are pressed into contact with the wire-side terminal fittings 30. The coupling member Fb aligns the end portions of the inner conductors Wa. Thus, the inner conductors Wa are inserted into connection with all the wire-connecting portions 31 substantially at the same time. The inner conductors Wa transversely widen the slits 34 and connect with the wire-side terminal fittings 30 at a specified contact pressure due to the resilient restoring forces of the wire-connecting portions 31.

The exposed portions of the cores Wb and the exposed portions of the shielding layers Wc are accommodated in the wire accommodating portions 20 when the wires W are connected. Additionally, the corresponding pairs of squeezing projections 21 squeeze the exposed portions of the shielding layers Wc from opposite sides. The coupling member Fb is placed substantially on the upper surfaces of the horizontal portions 32 of the wire connecting portions 31 and on the upper surfaces of the lower wall portions 15L, 16L of the partition walls 15 and the outer walls 16. The flat cable F is connected with the wire-side terminal fittings 30 at the lower stage in a similar manner. In this way, two flat cables F are mounted in and connected to one housing 11, a plurality of wires W are divided into upper and lower stages while being arranged substantially side by side at substantially the same intervals at each stage.

Upper and lower shielding shells 24 are assembled on the housing 11 after the flat cables F are connected to shield the wire-side terminal fittings 30 in the housing 11. The upper shielding shell 24 is mounted on the upper surface of the housing 11 to cover the wire-side terminal fittings 30 at the upper stage. Similarly, the lower shielding shell 24 is mounted on the lower surface of the housing 11 to cover the wire-side terminal fittings 30 at the lower stage. The upper and lower shielding shells 24 are locked in their assembled state with the housing 11 by engaging locking pieces 25 and locking holes 26. Conducting pieces 27 at the rear ends of the assembled shielding shells 24 contact the exposed portions of the shielding layers Wc and pressing projections 28 formed near the conducting pieces 27 press the coupling members Fb toward the partition wall 22. Each shielding shell 24 has an escaping hole 29 for avoiding contact with the vertical portions 33 of the wire connecting portions 31.

The board-side connector 40 includes a housing 41 e.g. made of a synthetic resin. Cavities 42 in the form of vertical slits penetrate the housing 41 substantially along the connecting direction CD. The cavities 42 are arranged transversely at substantially the same intervals as the wire-side contact pieces 35 in the wire-side connector 10.

The board-side terminal fittings 43A, 43B are made of conductive metallic plate stamped or cut out to have specified shapes and are fit into the respective cavities 42 from behind. Each board-side terminal fitting 43A, 43B has a board connecting portion 44 for connection with the circuit board P and a board-side contact piece 45A, 45B substantially continuous with the front end of the board connecting portion 44. Each board-side contact piece 45A, 45B is forked and includes upper and lower squeezing pieces 46*a*, 46*b* that cantilever forward in the connecting direction CD.

The board-side terminal fittings 43A, 43B have a common board connecting portion 44, but differently shaped board-side contact pieces 45A, 45B. Specifically, each board-side terminal fitting 43A to be connected with the wire-side terminal fitting 30 at the upper stage has an upper squeezing piece 46*a* that is longer than the lower squeezing piece 46*b* and has a downward-projecting contact 47 at the front end of the upper squeezing piece 46*a*. On the other hand, each board-side terminal fitting 43B to be connected with the wire-side terminal fitting 30 at the lower stage has a lower squeezing piece 46*a* that is longer than the upper squeezing piece 46*b* and has an upward-projecting contact 47 at the front end of the lower squeezing piece 46*b*. In other words, the board-side contact pieces 45A of the board-side terminal fittings 43A for the upper stage and the board-side contact pieces 45B of the board-side terminal fittings 43B for the lower stage are substantially vertically symmetrical and are substantially symmetrical along a direction normal to the connecting direction CD and/or the transverse direction TD.

A vertical interval between the vertically corresponding squeezing pieces 46*a* and 46*b* is shorter than a distance between the upper surface of the receiving portion 19 at the upper stage and the lower surface of the wire-side contact piece 35 at the lower stage and is shorter than a distance from the lower surface of the receiving portion 19 at the lower stage to the upper surface of the wire-side contact piece 35 at the upper stage. Further, the thickness of the board-side terminal fittings 43A, 43B along the transverse direction TD is less than the width of the wire-side contact pieces 35 along the transverse direction TD. The two kinds of board-side terminal fittings 43A, 43B are arranged alternately along the transverse direction TD. The housing 41 also has a forwardly open engaging recess 48 that is a wide slit extending over substantially the entire width and having a height substantially corresponding a distance between the vertically corresponding squeezing portions 46*a*, 46*b*.

The board-side connector 40 is fixed to the upper surface of the circuit board P beforehand, and the board connecting portions 44 of the board-side terminal fittings 43A, 43B are connected with circuits (not shown) on the circuit board P. The wire-side connector 10 then is connected with the board-side connector 40. More particularly, the wire-side connector 10 is brought closer to the board-side connector 40 along the connecting direction CD at substantially the same height as the board-side connector 40 to fit a front portion of the partition wall 22 of the wire-side connector 10 and the respective wire-side contact pieces 35 into the engaging recess 48 of the board-side connector 40. Additionally, front portions of the shielding shells 24 of the wire-side connector 10 fit onto a front portion of the board-side connector 40. Further, the lower surface of the lower shielding shell 24 is connected with a grounding circuit (not shown) on the circuit board P.

With the two connectors 10, 40 properly connected, the respective board-side terminal fittings 43A, 43B engage and electrically connect with the corresponding wire-side terminal fittings 30 at the upper and lower stages.

Figure 8:
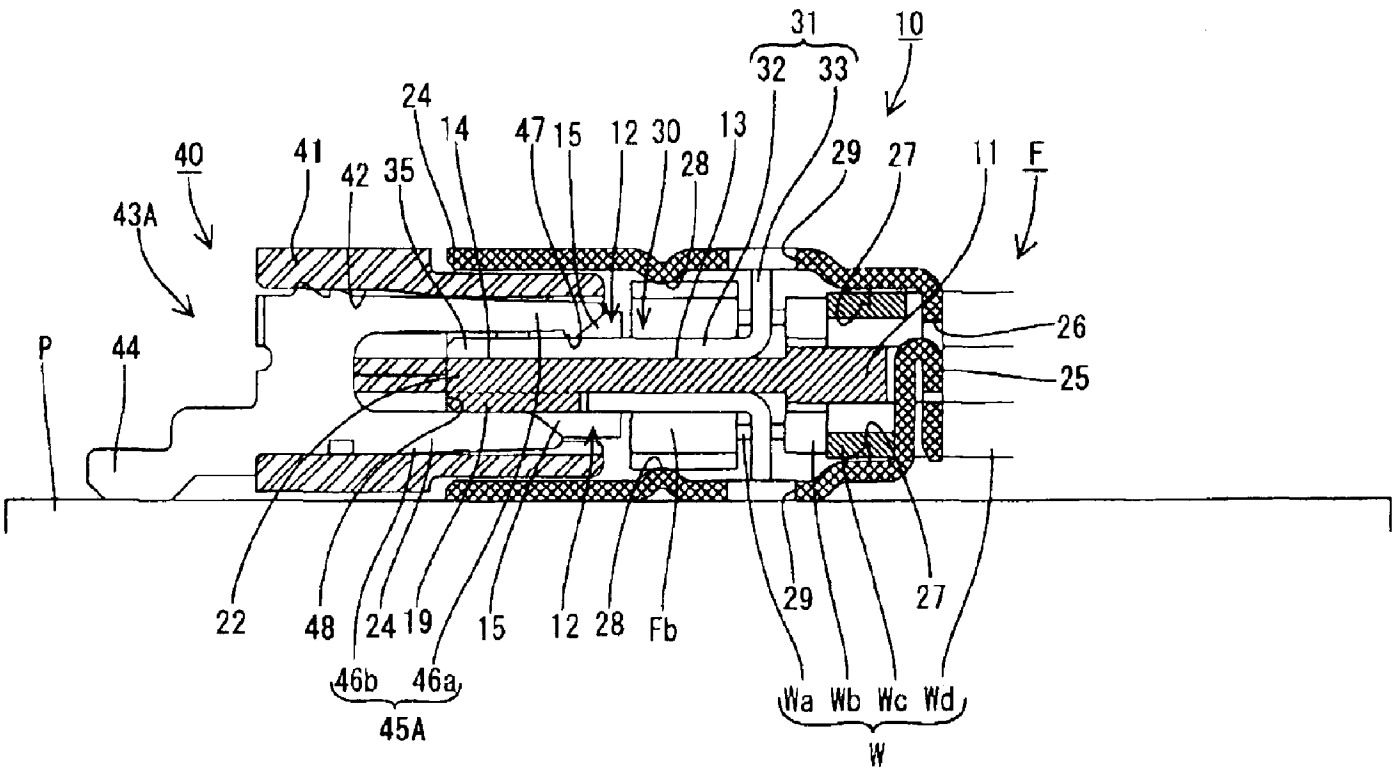
FIG. 8 is a section showing a connected state of the wire-side terminal fitting and the wire-side terminal fitting at the upper stage.

Specifically, as shown in FIG. 8, the squeezing portions 46*a*, 46*b* of the board-side terminal fittings 43A for the upper stage squeeze the wire-side contact pieces 35 at the upper stage, the partition wall 22 and the receiving portions 19 at the lower-surface from substantially opposite sides. As a result, the upper squeezing portions 46*a* contact the wire-side contact pieces 35 at the upper stage from above and the lower squeezing portions 46*b* contact the receiving portions 19 at the lower-surface side from below. In this way, the board-side terminal fittings 43A for the upper stage connect with the wire-side terminal fittings 30 at the upper stage.

Figure 9:
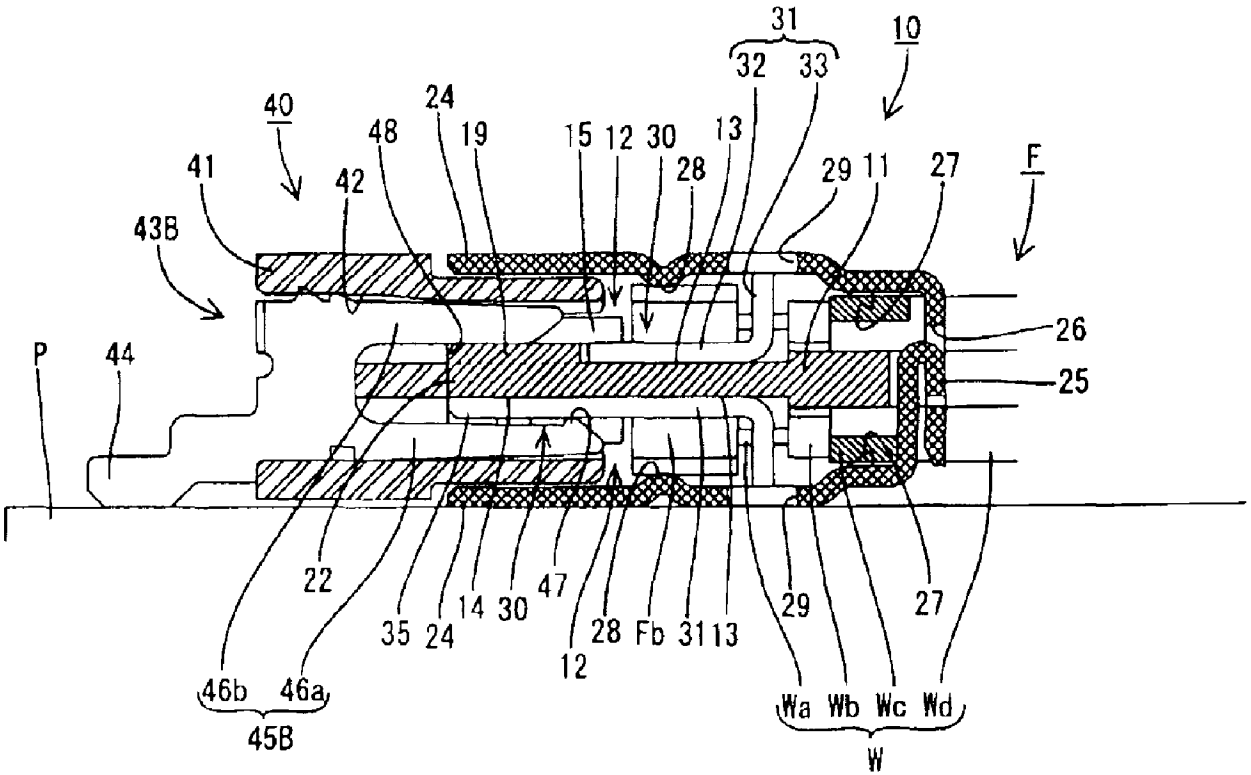
FIG. 9 is a section showing a connected state of the wire-side terminal fitting and the wire-side terminal fitting at the lower stage.

On the other hand, as shown in FIG. 9, the squeezing portions 46*a*, 46*b* of the board-side terminal fittings 43B for the lower stage squeeze the wire-side contact pieces 35 at the lower stage, the partition wall 22 and the receiving portions 19 at the upper-surface side from above and below. As a result, the upper squeezing portions 46*b* contact the receiving portions 19 at the upper-surface side from above and the lower squeezing portions 46*a* contact the wire-side contact pieces 35 at the lower stage from below. In this way, the board-side terminal fittings 43A for the lower stage are connected with the wire-side terminal fittings 30 at the lower stage. The squeezing portions 46*b* that will contact the receiving portions 19 are shorter than the squeezing portions 46*a* that will contact the wire-side contact pieces 35. Thus, there is no possibility that the squeezing portions 46*b* will contact the wire-connecting portions 31 arranged at the same side as the receiving portions 19.

The wire-side terminal fittings 30 are divided into upper and lower stages so that the wire-connecting portions 31 are one over the other to narrow the width of the connector. The wire-side contact pieces 35 and the board-side contact pieces 45A, 45B are narrower than the wire-side connecting portions 31. Thus, two wire-side contact pieces 35 at the upper and lower stages can be arranged substantially side-by-side at substantially the same height in the width area taken up by one wire-connecting portion 31. Additionally, the board-side terminal fittings 43A for the upper stage and the board-side terminal fittings 43B for the lower stage can be arranged at substantially the same height. Thus, the height needed to connect the contact pieces 35, 45A at the upper stage and the height needed to connect the contact pieces 35, 45B at the lower stage can be substantially the same height. As a result, the height of the connector is shorter as compared to connectors in which contact pieces at the upper and lower stages located one over the other.

The board-side contact pieces 45A, 45B are forked and squeeze the wire-side contact pieces 35 to connect the terminal fittings 30, 43A. Thus, high contact pressure is ensured by the resilient forces of the contact pieces 45A, 45B. Accordingly, no load acts on the resin housings 11, 41, and the housings 11, 41 will not deform. Thus, contact reliability is improved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The board-side contact pieces are forked in the foregoing embodiment. However, the wire-side contact pieces may be forked and the board-side contact pieces may be squeezed between the forked portions of the wire-side contact pieces according to the present invention.

Identical wire-side terminal fittings are arranged in a vertically inverted relationship at the upper and lower stages in the foregoing embodiment, the wire-side terminal fittings at the upper stage may be shaped differently from those at the lower stage according to the present invention.

The wire-side contact pieces or the board-side contact pieces are forked in the foregoing embodiment. However, all of the contact pieces may project in the form of a single bar without being forked.

All wire-side contact pieces are in the form of a single bar and all the board-side terminal fittings are forked in the foregoing embodiment. However, a connection mode in which the forked wire-side contact piece contacts the board-side contact in the form of a single bar and a connection mode in which the forked board-side contact piece contacts the wire-side contact piece in the form of a single bar may be mixed according to the present invention.

The wire connecting portions are press-contact blades and the wires are pressed into connection in the foregoing embodiment. However, the invention also is applicable to a case where the wires may be connected by other means, such as crimping, soldering, welding, ultrasonic welding, etc.

The flat cables have a shielding function in the foregoing embodiment. However, the invention also is applicable to a case where the flat cables have no shielding function.

Although the board-side terminal fittings to be connected with the wire-side terminal fittings at the upper stage and those to be connected with the wire-side terminal fittings at the lower stage are shaped differently in the foregoing embodiment. However, they may have a common shape for the first/upper and second/lower stages according to the present invention.

What is claimed is:

1. A connector assembly for connecting a flat cable with an electric device, the flat cable having a plurality of wires arranged substantially side-by-side, the connector assembly comprising:

a wire-side connector accommodating wire-side terminal fittings, the wire-side terminal fittings having wire-connecting portions for connection with the wires-and having wire-side contact pieces that are narrower than the wire-connecting portions, and a board-side connector accommodating board-side terminal fittings to be connected with the electric device, the board-side terminal fittings having board side contact pieces that are narrower than the wire-connecting portions, wherein:

the wire-side terminal fittings and the board-side terminal fittings are electrically connectable by bringing the wire-side contact pieces and the board-side contact pieces into contact from substantially opposite sides, and the wire-side terminal fittings being disposed at first and second stages and being substantially side-by-side at each stage to define pairs of wire-side terminal fittings, with each said pair having one of said wire-side terminal fittings from each of said stages, the wire-side terminal fittings in each said pair being arranged so that the wire-connecting portions thereof are located at least partly over one another and the wire-side contact pieces thereof are substantially side by side at substantially the same height in a width area taken up by one wire-connecting portion.

2. The connector assembly of claim 1, wherein the board-side contact pieces are forked and vertically squeeze the wire-side contact pieces from substantially opposite sides to electrically connect the wire-side terminal fittings and the board-side terminal fittings.

3. The connector assembly of claim 2, wherein each of said forked contact pieces includes first and second squeezing pieces having different projecting lengths substantially along a connecting direction of the two connectors.

4. The connector assembly of claim 1, wherein the wire-side terminal fittings at the first stage and the wire-side terminal fittings at the second stage are substantially identical but are arranged in a vertically inverted relationship at the respective first and second stages.

5. The connector assembly of claim 1, wherein a holding means is provided for holding the wire-side contact piece with respect to the wire-side connector.

6. The connector assembly of claim 1, wherein the wire-side connector comprises a plurality of terminal accommodating portions for accommodating the respective wire-side terminal fittings.

7. The connector assembly of claim 6, wherein adjacent terminal accommodating portions are partitioned partitioning walls.

8. The connector assembly of claim 7, wherein each terminal accommodating portion comprises a wide accommodating portion for accommodating the wire connecting portion and a narrow accommodating portion for accommodating the wire-side contact piece.

9. The connector assembly of claim 8, wherein the narrow accommodating portion is less than about half as wide as the wide accommodating portion.

10. The connector assembly of claim 1, further comprising at least one shielding shell for substantially shielding the connectors.

11. A connector for flat cables, each said flat cable having a plurality of wires arranged substantially side-by-side, the connector comprising:

a housing having a partition and first and second arrays of side-by-side terminal accommodating recesses on opposite sides of the partition for defining pairs of terminal accommodating recesses, each said pair having one of said terminal accommodating recesses from each of said arrays and the terminal accommodating recesses in each said pair being aligned with one another in a direction transverse to the partition; and terminal fittings accommodated respectively in the terminal accommodating recesses, each of the terminal fittings having a wire-connecting portion for connection one of said wires and having a contact piece that is narrower than the wire-connecting portion, the wire-connecting portions in each said pair of terminal accommodating recesses being substantially aligned with one another in the direction transverse to the partition, and the contact pieces in each said pair of terminal accommodating recesses being offset from one another in the direction transverse to the partition.

12. The connector of claim 11, wherein each said contact piece is substantially planar and lies in contact with the partition.

13. The connector of claim 12, wherein each said contact piece extends from the partition wall less than a projection of the respective wire-connecting portion from the partition.

14. The connector assembly of claim 11, wherein the terminal fittings in the first array and the terminal fittings in the second array are substantially identical but are arranged in an inverted relationship at the respective first and second arrays.

15. The connector assembly of claim 14, further comprising holding means for holding each said contact piece with respect to the housing.

16. A connector assembly for connecting flat cables to a device, each said flat cable having a plurality of wires arranged substantially side-by-side, the connector assembly comprising:

a wire-side connector having a partition and first and second arrays of side-by-side terminal accommodating recesses on opposite sides of the partition for defining pairs of terminal accommodating recesses, each said pair having one of said terminal accommodating recesses from each of said arrays, wire-side terminal fittings accommodated respectively in the terminal accommodating recesses, each of the wire-side terminal fittings having a wire-connecting portion for connection to one of said wires and having a wire-side contact piece that is narrower than the wire-connecting portion, the wire-connecting portions in each said pair of terminal accommodating recesses being substantially aligned with one another in the direction transverse to the partition, and the wire-side contact pieces in each said pair of terminal accommodating recesses being offset from one another in the direction transverse to the partition; and a board-side connector accommodating board-side terminal fittings to be connected with the device, each board-side terminal fitting having first and second squeezing pieces that are connectable to a corresponding one of the wire-side terminal fittings by squeezing the partition wall and the respective wire-side contact pieces from substantially opposite sides.

17. The connector assembly of claim 16, wherein the first and second squeezing pieces have different projecting lengths substantially along a connecting direction of the two connectors.

* * * * *